US007441363B1

(12) United States Patent
Black et al.

(10) Patent No.: US 7,441,363 B1
(45) Date of Patent: Oct. 28, 2008

(54) GUN BORE CLEANING SYSTEM

(75) Inventors: Wesley F. Black, Williston, ND (US); Charles D. Black, Williston, ND (US)

(73) Assignee: New Products Marketing Company, Williston, ND (US)

( * ) Notice: Subject to any disclaimer, the term of this patent is extended or adjusted under 35 U.S.C. 154(b) by 242 days.

(21) Appl. No.: 11/132,692

(22) Filed: May 18, 2005

Related U.S. Application Data

(60) Provisional application No. 60/646,403, filed on Jan. 21, 2005, provisional application No. 60/607,203, filed on Sep. 2, 2004.

(51) Int. Cl.
*F41A 29/00* (2006.01)

(52) U.S. Cl. ..... 42/95; 15/104.3

(58) Field of Classification Search ..... 42/95; 15/104.05, 104.16, 104.03, 104.067, 104.062; D22/199; 134/8
See application file for complete search history.

(56) References Cited

U.S. PATENT DOCUMENTS

| | | | | | |
|---|---|---|---|---|---|
| 514,514 | A | * | 2/1894 | Stafford | 15/104.05 |
| 621,857 | A | * | 3/1899 | Scott et al. | 15/104.165 |
| 882,598 | A | * | 3/1908 | Ward | 15/104.16 |
| 883,986 | A | * | 4/1908 | Swazey | 15/104.05 |
| 1,004,710 | A | * | 10/1911 | Swazey | 15/104.05 |
| 1,061,119 | A | | 5/1913 | P'Pool | |
| 1,164,665 | A | | 12/1915 | Reeves | |
| 1,548,475 | A | | 8/1925 | Moccia | |
| 2,544,847 | A | * | 3/1951 | Malesky | 15/104.165 |
| 2,616,109 | A | * | 11/1952 | Gardner | 15/104.165 |
| 2,834,973 | A | * | 5/1958 | Friesen | 15/104.165 |
| 2,897,525 | A | | 8/1959 | Goodwin et al. | 15/104.165 |
| 3,205,518 | A | * | 9/1965 | Romaine | 15/104.165 |
| 3,682,556 | A | | 8/1972 | Hanson | 401/132 |
| 3,708,820 | A | | 1/1973 | Schultea | 15/104.16 |
| 4,399,627 | A | | 8/1983 | Malesky et al. | 42/1 |
| 4,497,082 | A | | 2/1985 | Kogasaka | 15/104.165 |
| 4,499,625 | A | | 2/1985 | Bottomley | 15/104.165 |
| 4,716,673 | A | | 1/1988 | Williams et al. | 42/95 |
| 5,074,074 | A | * | 12/1991 | Yeadon | 42/95 |
| 5,171,925 | A | | 12/1992 | Mekler | 42/95 |
| 5,588,242 | A | | 12/1996 | Hughes | 42/95 |
| 5,836,099 | A | | 11/1998 | Pace et al. | 42/95 |
| 5,871,589 | A | | 2/1999 | Hedge | 134/8 |
| 5,972,125 | A | | 10/1999 | Hedge | 134/8 |
| 6,088,866 | A | | 7/2000 | Hedge | 15/104.16 |
| 6,131,229 | A | * | 10/2000 | Lincuna et al. | 15/104.33 |
| 6,630,034 | B1 | | 10/2003 | Schnell | 134/8 |
| 6,889,402 | B2 | * | 5/2005 | Galantai | 15/104.05 |
| 2004/0111948 | A1 | * | 6/2004 | Schnell | 42/95 |

* cited by examiner

*Primary Examiner*—Benjamin P Lee
(74) *Attorney, Agent, or Firm*—Michael Neustel

(57) ABSTRACT

A gun bore cleaning system for efficiently cleaning a bore of a gun. The gun bore cleaning system includes a cord having a plurality of receiver openings for removably receiving a corresponding plurality of swabs. The cord is extendable into the bore of a gun for cleaning the bore in a reciprocating manner. A brush may also be removably attached to the cord, wherein the brush has a plurality of radially extending bristles. The swabs and the brush may also be non-removably attached to the cord.

6 Claims, 9 Drawing Sheets

GUN BORE CLEANING SYSTEM

CROSS REFERENCE TO RELATED APPLICATIONS

I hereby claim benefit under Title 35, United States Code, Section 119(e) of U.S. provisional patent application Ser. No. 60/646,403 filed Jan. 21, 2005 and Ser. No. 60/607,203 filed Sep. 2, 2004. The 60/646,403 application and 60/607,203 application are currently pending. The 60/646,403 application and 60/607,203 application are hereby incorporated by reference into this application.

STATEMENT REGARDING FEDERALLY SPONSORED RESEARCH OR DEVELOPMENT

Not applicable to this application.

BACKGROUND OF THE INVENTION

1. Field of the Invention

The present invention relates generally to gun bore cleaning devices and more specifically it relates to a gun bore cleaning system for efficiently cleaning a bore of a gun.

2. Description of the Related Art

Any discussion of the prior art throughout the specification should in no way be considered as an admission that such prior art is widely known or forms part of common general knowledge in the field.

Gun bore cleaning devices have been in use for years. Conventional gun bore cleaning devices are typically comprised of a plurality of bristles (e.g. bronze, copper, nylon) threadably attached to a relatively rigid cleaning rod.

One problem with conventional gun bore cleaning devices is that they require a considerable amount of time to assemble. Another problem with conventional gun bore cleaning devices is that they are relatively expensive for consumers to purchase. Another problem with conventional gun bore cleaning devices is that they must be cleaned prior to storage. A further problem with conventional gun bore cleaning devices is that they must be stored when not in use. Another problem with conventional gun bore cleaning devices is that they are not readily disposable.

While these devices may be suitable for the particular purpose to which they address, they are not as suitable for efficiently cleaning a bore of a gun. Conventional gun bore cleaning devices are relatively expensive, time consuming to utilize, require cleaning, and are not easily stored.

In these respects, the gun bore cleaning system according to the present invention substantially departs from the conventional concepts and designs of the prior art, and in so doing provides an apparatus primarily developed for the purpose of efficiently cleaning a bore of a gun.

BRIEF SUMMARY OF THE INVENTION

In view of the foregoing disadvantages inherent in the known types of gun bore cleaning devices now present in the prior art, the present invention provides a new gun bore cleaning system construction wherein the same can be utilized for efficiently cleaning a bore of a gun.

The general purpose of the present invention, which will be described subsequently in greater detail, is to provide a new gun bore cleaning system that has many of the advantages of the gun bore cleaning devices mentioned heretofore and many novel features that result in a new gun bore cleaning system which is not anticipated, rendered obvious, suggested, or even implied by any of the prior art gun bore cleaning devices, either alone or in any combination thereof.

To attain this, the present invention generally comprises a cord having a plurality of receiver openings for removably receiving a corresponding plurality of swabs. The cord is extendable into the bore of a gun for cleaning the bore. A brush may also be removably attached to the cord, wherein the brush has a plurality of radially extending bristles. The swabs and the brush may also be non-removably attached to the cord.

There has thus been outlined, rather broadly, the more important features of the invention in order that the detailed description thereof may be better understood, and in order that the present contribution to the art may be better appreciated. There are additional features of the invention that will be described hereinafter and that will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of the description and should not be regarded as limiting.

A primary object of the present invention is to provide a gun bore cleaning system that will overcome the shortcomings of the prior art devices.

A second object is to provide a gun bore cleaning system for efficiently cleaning a bore of a gun.

Another object is to provide a gun bore cleaning system that does not require assembly.

An additional object is to provide a gun bore cleaning system that is relatively inexpensive.

A further object is to provide a gun bore cleaning system that is disposable or non-disposable.

Another object is to provide a gun bore cleaning system that does not require cleaning.

A further object is to provide a gun bore cleaning system that may be conveniently stored in a relatively small area.

Another object is to provide a gun bore cleaning system that does not require a user to directly contact a contaminated swab.

Other objects and advantages of the present invention will become obvious to the reader and it is intended that these objects and advantages are within the scope of the present invention.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein.

DETAILED DESCRIPTION OF THE INVENTION

A. Overview

Figure 1:
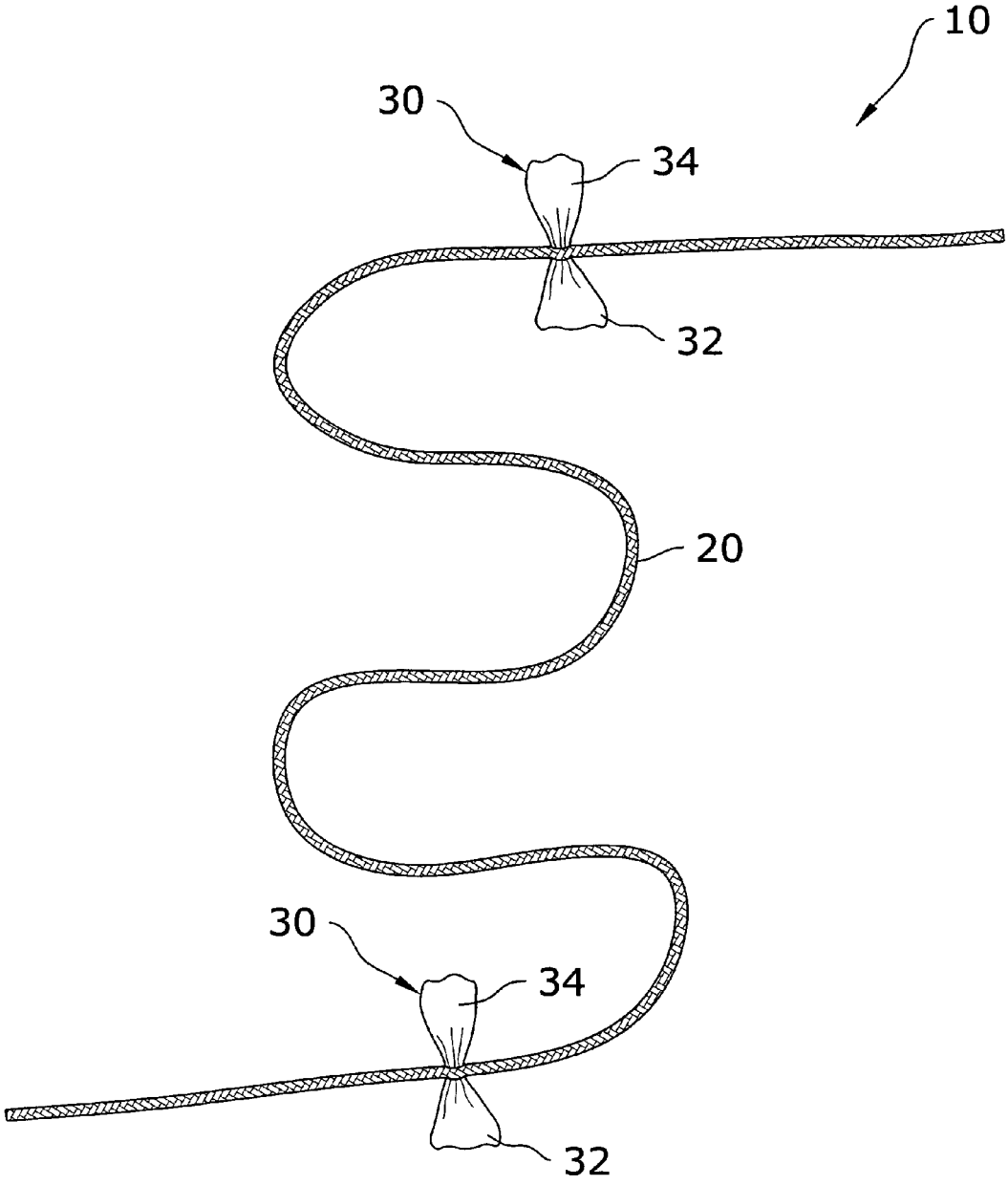
FIG. 1 is an upper perspective view of the present invention.

Turning now descriptively to the drawings, in which similar reference characters denote similar elements throughout the several views, FIGS. 1 through 14 illustrate a gun bore cleaning system 10, which comprises a cord 20 having a plurality of receiver openings 22 for removably receiving a corresponding plurality of swabs 30. The cord 20 is extendable into the bore 16 of a gun 12 for cleaning the bore 16. A brush 40 may also be removably attached to the cord 20, wherein the brush 40 has a plurality of radially extending bristles 42. The swabs 30 and the brush 40 may also be non-removably attached to the cord 20.

B. Cord

Figure 6:
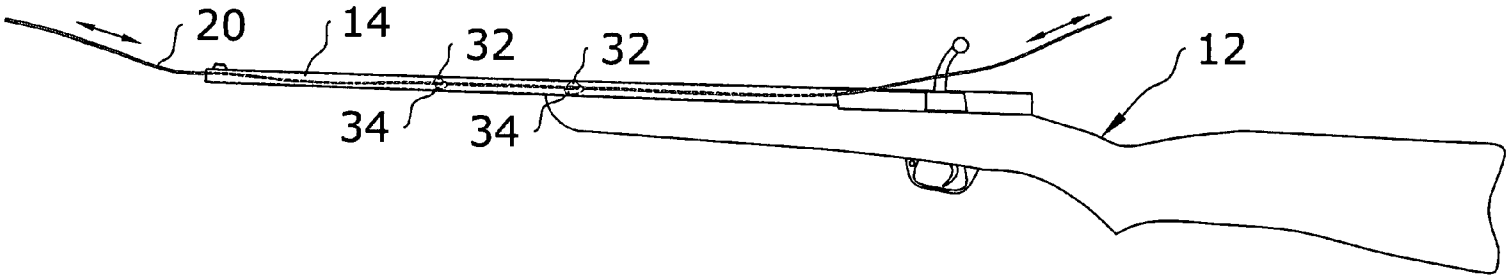
FIG. 6 is a side view of the present invention being utilized within a barrel of a gun.
Figure 7:
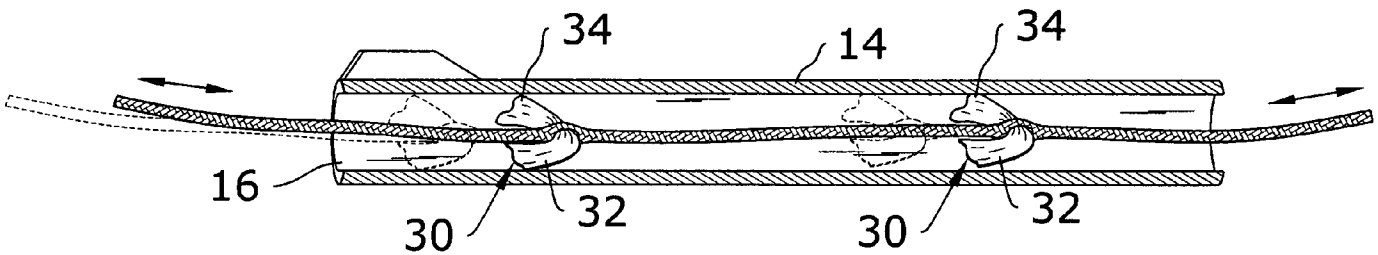
FIG. 7 is a side cutaway view of the present invention positioned within a bore of a gun.
Figure 10:
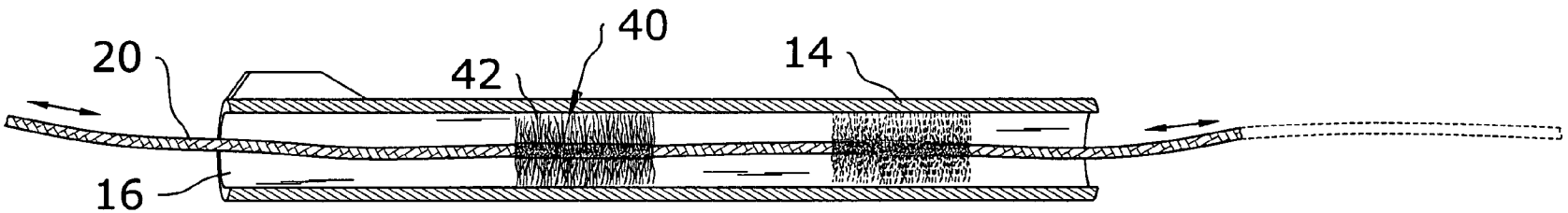
FIG. 10 is a side cutaway view of the alternative embodiment utilized within a bore of a barrel.

The cord 20 is comprised of an elongated flexible structure having a first end and a second end. The length of the cord 20 is sufficient to pass the first end completely through one end of the barrel 14 with the second end extended outside of the opposite end of the barrel 14 as shown in FIG. 6 of the drawings. The length of the cord 20 may be sufficient to allow for the severing of portions of the cord 20 as they become used and contaminated. The cord 20 has a width narrower than the bore 16 of the barrel 14 as illustrated in FIGS. 7 and 10 of the drawings. The cord 20 may be comprised of any material or structure that is flexible (e.g. natural or manmade fibers twisted or braided together).

The cord 20 includes at least one receiver opening 22 removably receiving the at least one swab 30. It is preferable that the cord 20 include a plurality of receiver openings 22 for receiving a corresponding plurality of swabs 30 as illustrated in FIG. 1 of the drawings.

Figure 2:
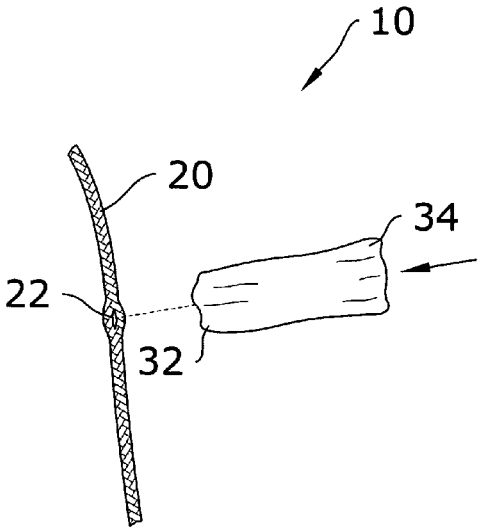
FIG. 2 is an exploded upper perspective view of a swab with respect to a receiver opening in the cord.

FIG. 2 illustrates a receiver opening 22 within the cord 20 for receiving a corresponding swab 30. It is preferable that a plurality of receiver openings 22 be utilized for receiving a corresponding plurality of swabs 30. The receiver openings 22 are preferably sized so as to snugly receive and retain the swabs 30 while allowing for the insertion and removal of the swabs 30. The swabs 30 are removable from and insertable into the receiver openings 22 of the cord 20 for allowing replacement of contaminated swabs 30. Alternatively, the swabs 30 may be permanently attached to the cord 20 via various attachment methods.

Figure 11:
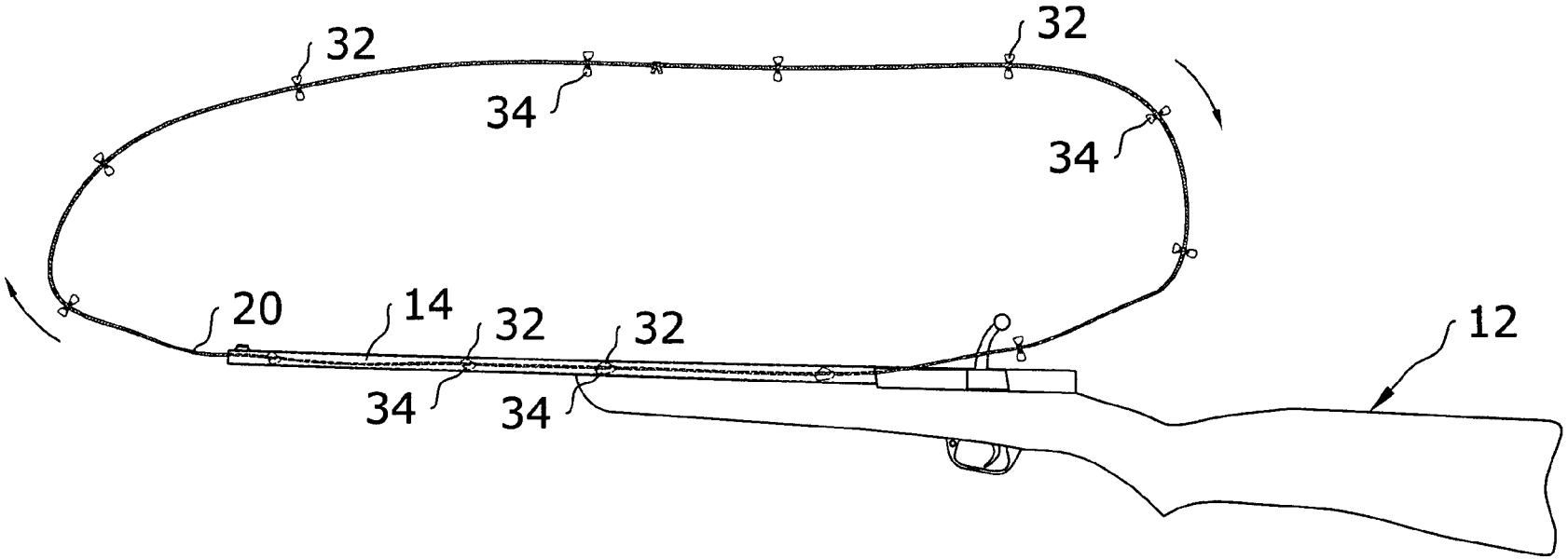
FIG. 11 is a side view of the present invention with the distal ends of the cord tied together forming a loop structure.
Figure 12:
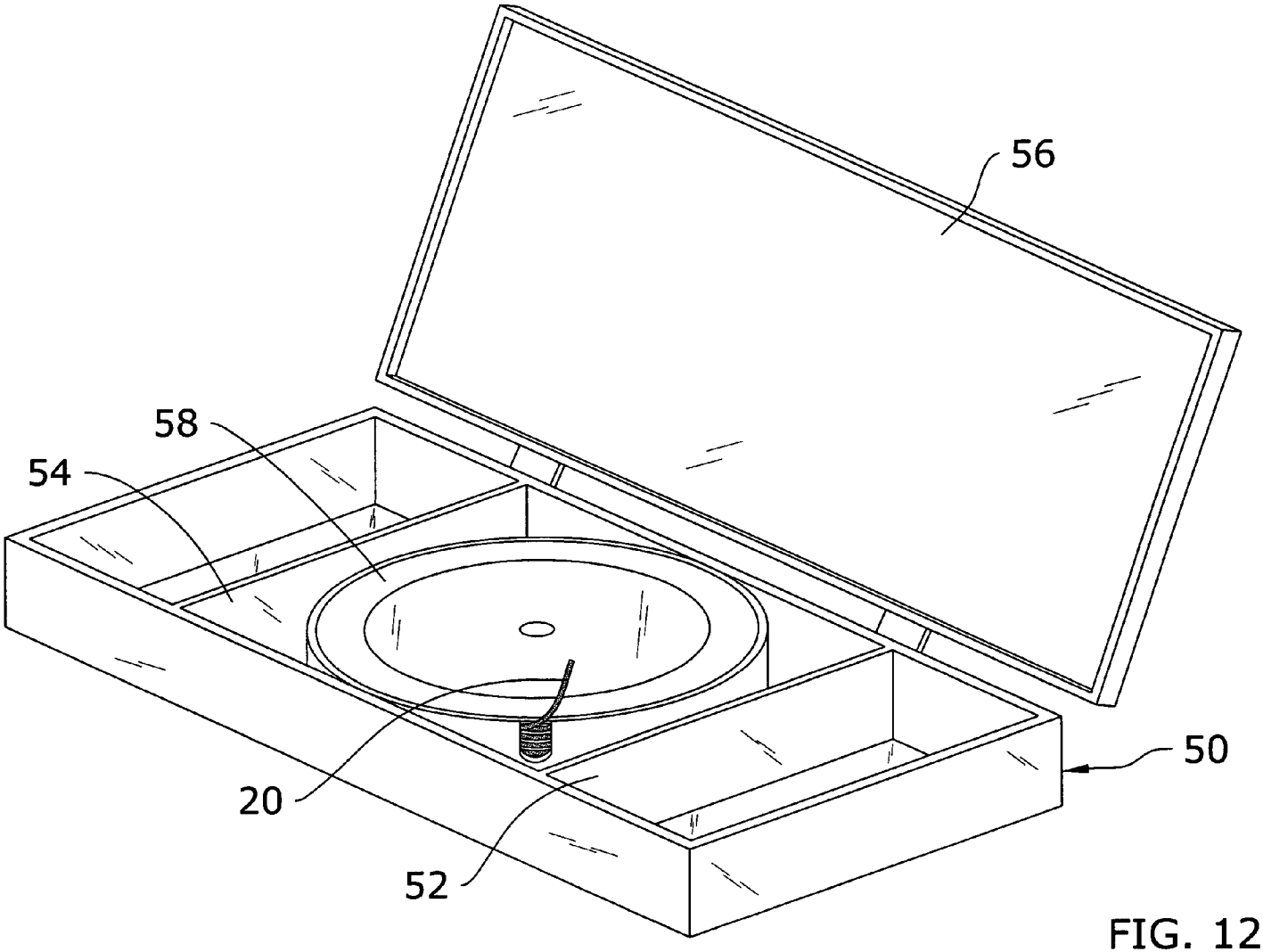
FIG. 12 is an upper perspective view of a housing structure capable of storing and dispensing the present invention.

In addition, the distal ends of the cord 20 may be tied together forming a loop structure as illustrated in FIG. 11 of the drawings. The loop structure for the cord 20 allows the user to move the cord 20 with the swabs 30 in a single direction away from the action parts of the gun 12. This prevents debris from falling into the action parts of the gun 12 during cleaning which can occur with conventional cleaning devices.

C. Swab

Figure 4:
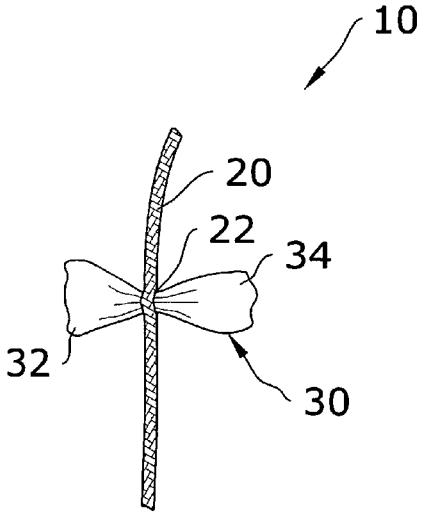
FIG. 4 is an upper perspective view of the swab fully inserted into the receiver opening in the cord.
Figure 5:
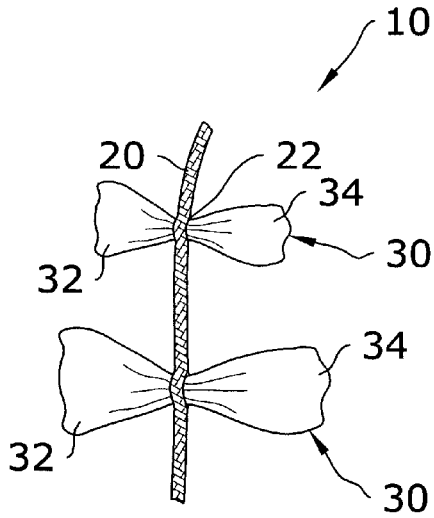
FIG. 5 is an upper perspective view of two swabs positioned within the cord having different sizes.

The swab 30 is attached to the cord 20 between the first end and the second end as shown in FIG. 1 of the drawings. The swab 30 has a first portion 32 and a second portion 34 extending on opposite sides of the cord 20 as best illustrated in FIGS. 4 and 5 of the drawings. It is preferable that a plurality of swabs 30 be attached to the cord 20.

The swab 30 is preferably comprised of a cloth material (e.g. natural or manmade textile fiber). The swab 30 may be comprised of various sizes, shapes and structures. The swab 30 is preferably comprised of a substantially flat structure prior to attachment to the cord 20 as shown in FIG. 2 of the drawings. However, various other structures may be utilized to construct the swab 30. The swab 30 is capable of receiving a volume of cleaning solvent or oil. As the swab 30 passes through the bore 16 of the barrel 14, the swab 30 both cleans and dries the inner wall of the bore 16.

The swabs 30 are preferably approximately four inches apart on the cord 20. The swabs 30 are preferably positioned in groups of 2 or more within approximately a six foot section to allow the user to sever the six foot section for cleaning a gun 12.

Figure 13:
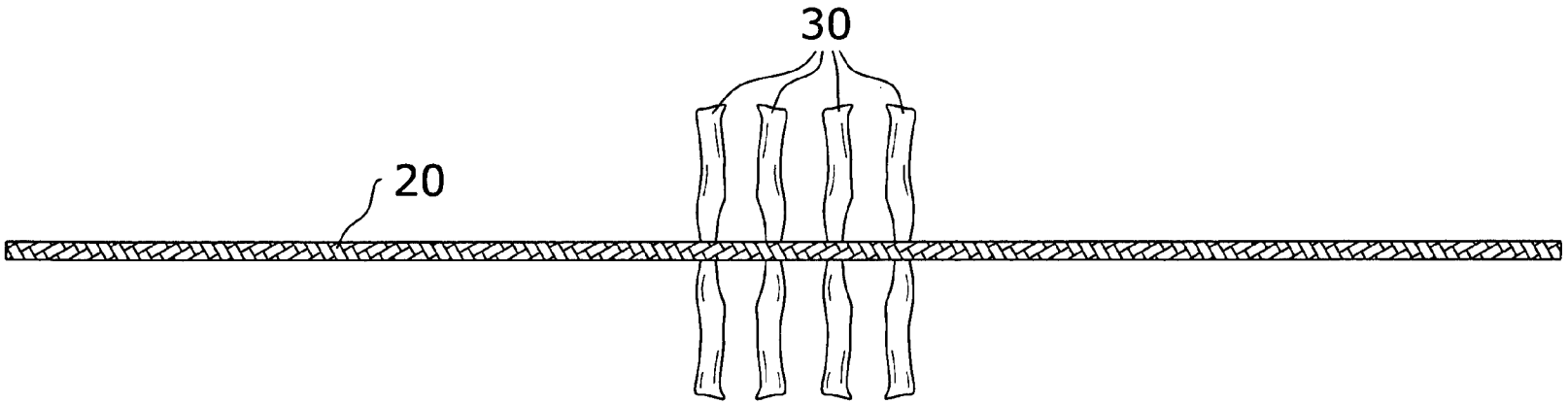
FIG. 13 is a side view of the present invention with the swabs closely positioned together to create an increased effective diameter for cleaning larger diameter bores.
Figure 14:
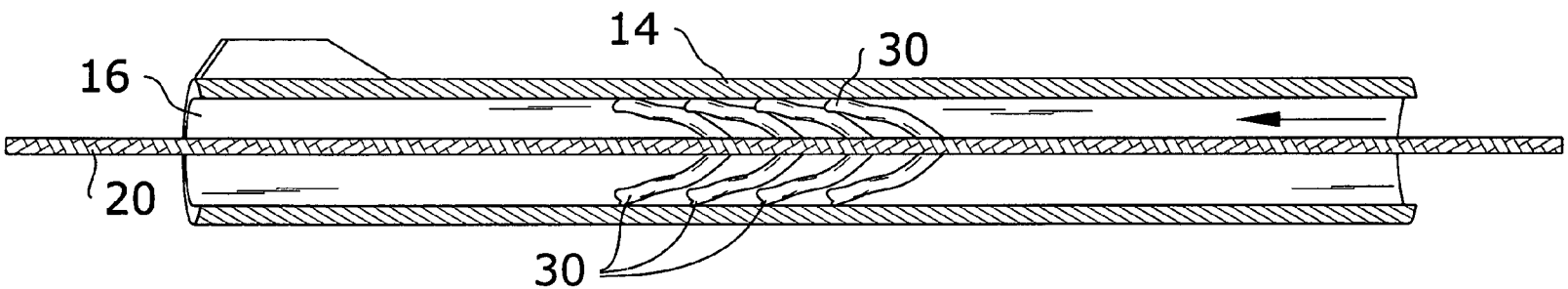
FIG. 14 is a side cutaway view illustrating the structure shown in FIG. 13 in use within a larger bore.

FIGS. 13 and 14 also illustrate an alternative embodiment where the swabs 30 are closely positioned together to effectively increase the cleaning diameter. The alternative embodiment for the present invention allows for the cleaning of bores having a larger diameter by utilizing relatively thin swabs 30.

D. Brush

Figure 8:
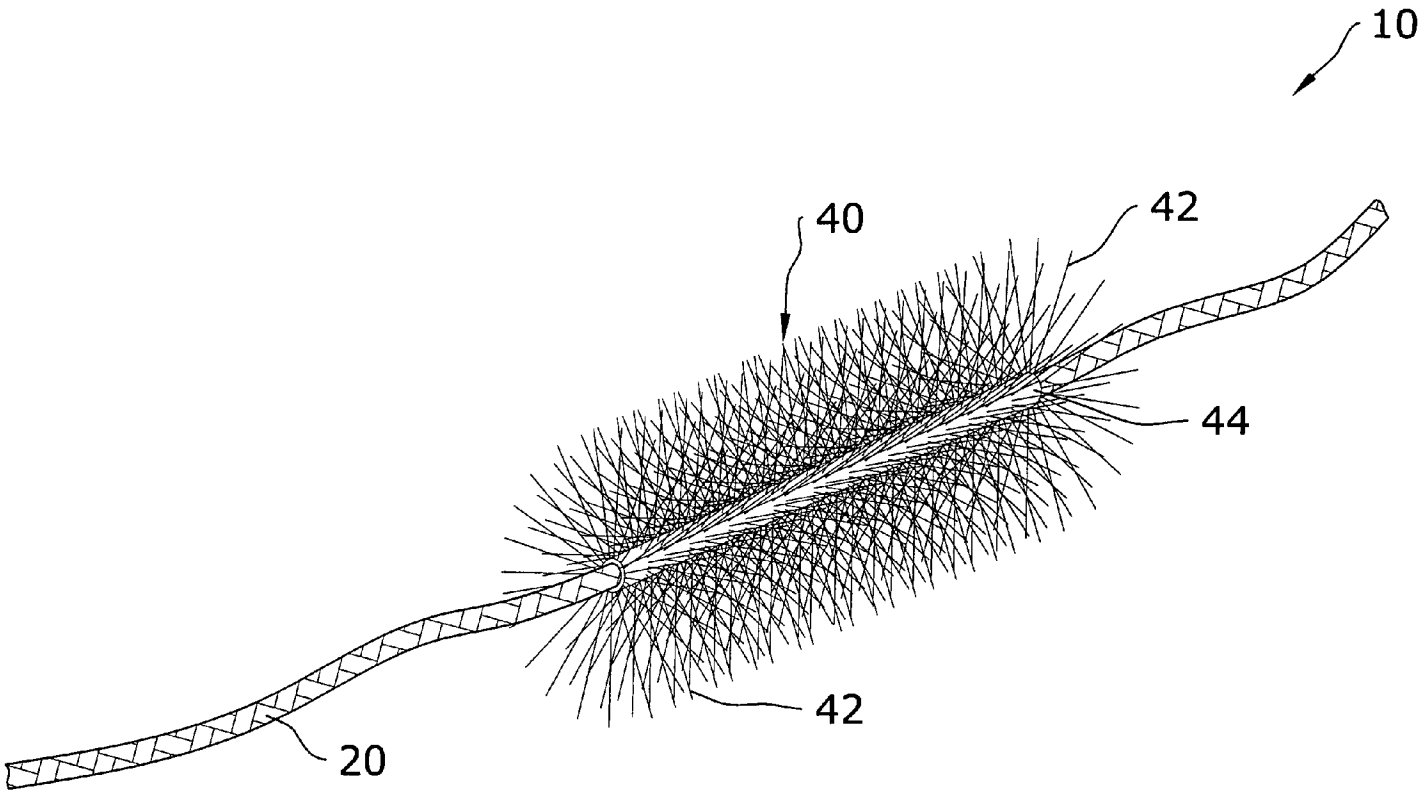
FIG. 8 is an upper perspective view of an alternative embodiment of the present invention utilizing a brush.
Figure 9:
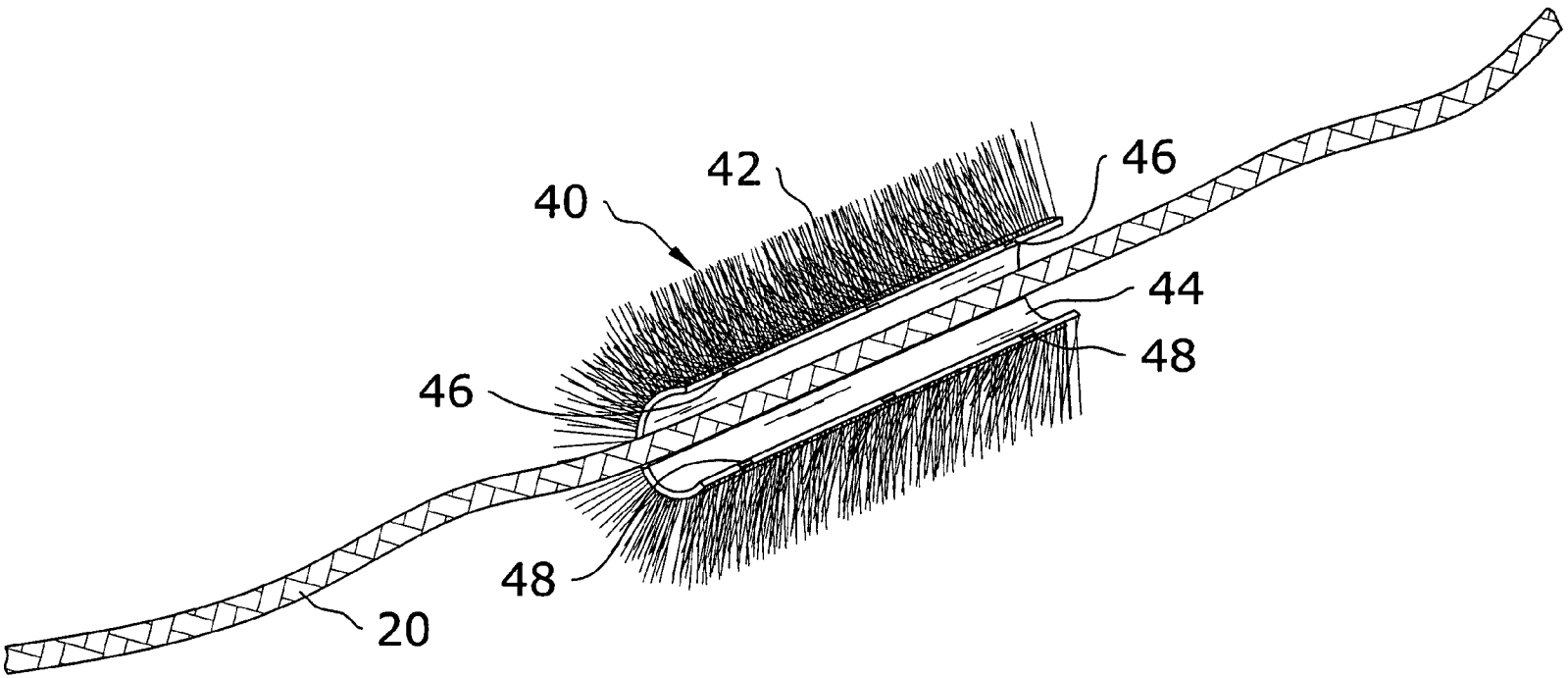
FIG. 9 is an upper perspective view of the alternative embodiment with the brush partially removed.

In an alternative embodiment shown in FIGS. 8 through 10 of the drawings, a brush 40 is attached to the cord 20 between the first end and the second end of the cord 20. The brush 40 is preferably removably attached to the cord 20, however the brush 40 may be non-removably attached to the cord 20. In addition, it is preferable that more than one brush 40 is attached to the cord 20 at various locations.

As shown in FIG. 9 of the drawings, the brush 40 includes a plurality of bristles 42 attached to a clamp 44. The plurality of bristles 42 extend outwardly and radially from the clamp 44 as shown in FIGS. 8 and 9 of the drawings. The clamp 44 is removably attachable to the cord 20 as further shown in FIG. 9 of the drawings.

FIG. 9 illustrates the clamp 44 having a cuff shaped structure where the distal ends are attached to one another. The clamp 44 includes at least one first fastener 46 attached to a first side of the clamp 44 and at least one second fastener 48 attached to a second side of the clamp 44 in opposition to one another. The first fastener 46 and the second fastener 48 are catchably attachable to one another thereby allowing securing of the clamp 44 about the cord 20 as illustrated in FIG. 8 of the drawings.

E. Operation of Invention

Figure 3:
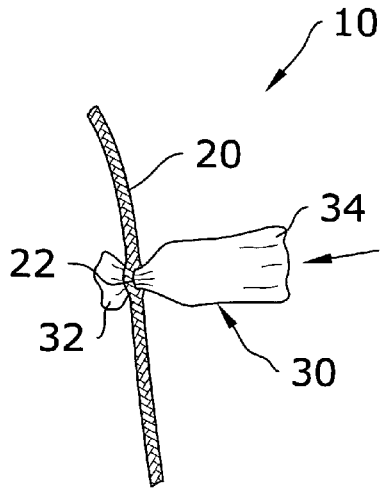
FIG. 3 is an upper perspective view of the swab partially inserted into the receiver opening in the cord.

In use, the user inserts one or more swabs 30 into the receiver openings 22 of the cord 20 as illustrated in FIGS. 2 through 4 of the drawings. Alternatively, at least one brush 40 is attached to the cord 20 as shown in FIG. 9 of the drawings. The user may apply cleaning solvent, oil or other substance prior to or after assembly within the cord 20. The user then extends a first end of the cord 20 into the bore 16 until the first end of the cord 20 extends outside of a first opening of the barrel 14 with the second end of the cord 20 still extending outside of a second opening of the barrel 14 as shown in FIG. 6 of the drawings. The cord 20 is then manually reciprocated creating a cleaning action within the bore 16 with the swabs 30 engaging the inner surface of the bore 16 for cleaning and drying. Alternatively, as shown in FIG. 11 of the drawings, the cord 20 is drawn through the bore 16 in a single direction if the cord 20 is tied into a loop structure. When the user is finished cleaning the bore 16 of the gun 12, the cord 20 is removed from the bore 16. The user may severe any worn, contaminated or otherwise unusable portion of the cord 20 to allow for usage of the remaining portion of the cord 20. The cord 20 may also be conveniently stored in various compact locations.

What has been described and illustrated herein is a preferred embodiment of the invention along with some of its variations. The terms, descriptions and figures used herein are set forth by way of illustration only and are not meant as limitations. Those skilled in the art will recognize that many variations are possible within the spirit and scope of the invention, which is intended to be defined by the following claims (and their equivalents) in which all terms are meant in their broadest reasonable sense unless otherwise indicated. Any headings utilized within the description are for convenience only and have no legal or limiting effect.

We claim:

1. A method of cleaning a bore of a gun, said method comprising the steps of:

providing a cord comprised of an elongated, continuous flexible material with a plurality of receiver openings between a first end and a second end thereof, wherein said plurality of receiver openings are sized to snugly receive and retain a swab;

providing a first swab;

applying a cleaning solvent or an oil to said first swab;

inserting an end of said first swab into a first receiver opening of said plurality of receiver openings;

pulling said first swab through said first receiver opening until said first swab has a first portion and a second portion extending outwardly from opposite sides of said cord;

providing a second swab;

applying a cleaning solvent or an oil to said second swab;

inserting an end of said second swab into a second receiver opening of said plurality of receiver openings;

pulling said second swab through said second receiver opening until said first swab has a first portion and a second portion extending outwardly from opposite sides of said cord;

extending said cord into a bore of a barrel of a gun until said first end of said cord extends outside of a first opening of said barrel and wherein said second end of said cord extends outside of a second opening of said barrel;

reciprocating said cord for cleaning said bore;

removing said cord from said bore;

severing a portion of said cord that is contaminated from said step of reciprocating said cord for cleaning said bore.

2. The method of cleaning a bore of a gun of claim 1, including the step of attaching said first end of said cord to said second end of said cord.

3. The method of cleaning a bore of a gun of claim 2, including the step of removing said cord from said bore.

4. The method of cleaning a bore of a gun of claim 2, wherein said step of providing a first swab includes applying a cleaning solvent or an oil to said first swab.

5. The method of cleaning a bore of a gun of claim 2, including the step of attaching said first end of said cord to said second end of said cord.

6. A method of cleaning a bore of a gun, said method comprising the steps of:

providing a cord comprised of an elongated, continuous flexible material with a plurality of receiver openings between a first end and a second end thereof, wherein said plurality of receiver openings are sized to snugly receive and retain a swab;

providing a first swab;

inserting an end of said first swab into a first receiver opening of said plurality of receiver openings;

pulling said first swab through said first receiver opening until said first swab has a first portion and a second portion extending outwardly from opposite sides of said cord;

providing a second swab;

inserting an end of said second swab into a second receiver opening of said plurality of receiver openings;

pulling said second swab through said second receiver opening until said first swab has a first portion and a second portion extending outwardly from opposite sides of said cord;

extending said cord into a bore of a barrel of a gun until said first end of said cord extends outside of a first opening of said barrel and wherein said second end of said cord extends outside of a second opening of said barrel;

reciprocating said cord for cleaning said bore; and severing a portion of said cord that is contaminated.

* * * * *